United States Patent [19]

Blodgett, Jr. et al.

[11] 4,015,508

[45] Apr. 5, 1977

[54] BURST DISPERSION CONTROL

[75] Inventors: Fredrick M. Blodgett, Jr., Essex Junction; Peter B. Schuyler, Richmond, both of Vt.

[73] Assignee: General Electric Company, Burlington, Vt.

[22] Filed: Sept. 29, 1975

[21] Appl. No.: 617,475

[52] U.S. Cl. ..... 89/12; 89/41 SM

[51] Int. Cl.[2] ..... F41D 7/04

[58] Field of Search ..... 89/1 L, 12, 41 A, 41 SM, 89/126, 127, 160

[56] References Cited

UNITED STATES PATENTS

| | | | |
|---|---|---|---|
| 3,342,105 | 9/1967 | Fagerstrom | 89/41 A |
| 3,897,714 | 8/1975 | Parrin et al. | 89/41 A |

*Primary Examiner*—Stephen C. Bentley
*Attorney, Agent, or Firm*—Bailin L. Kuch

[57] ABSTRACT

A Gatling-type gun is disclosed having a cam plate with a plurality of transversely elongated, gun-barrel receiving cam slots to guide the distal ends of the respective gun barrels. Each distal end of the gun barrel is free within the length of its cam slot, but does remain in a neutral position in said slot when the gun is not firing. During firing, gun vibration, centrifugal force and recoil motion combine to produce an apparently random cantilevered movement of the distal end of the gun barrel within the length of its slot and, thus a random barrel dispersion.

6 Claims, 6 Drawing Figures

104
42
46
22
34
36
38
32
50

24
14
30
28
48
18
26
20
27
16
44
40

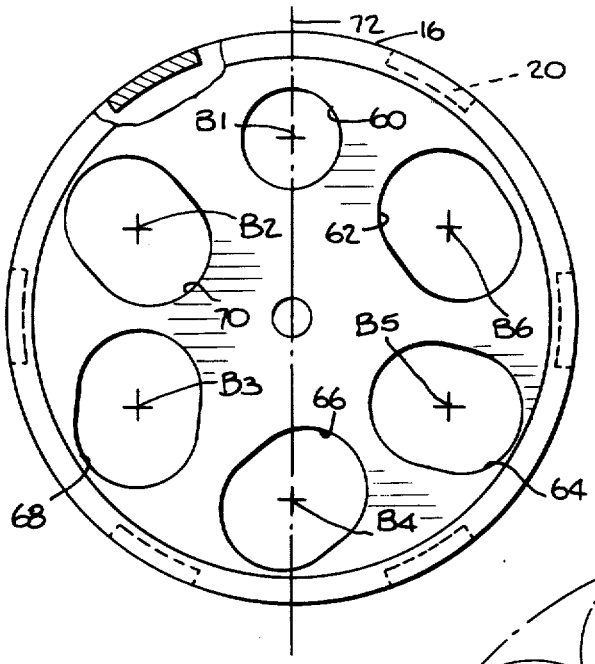
Fig. 3.
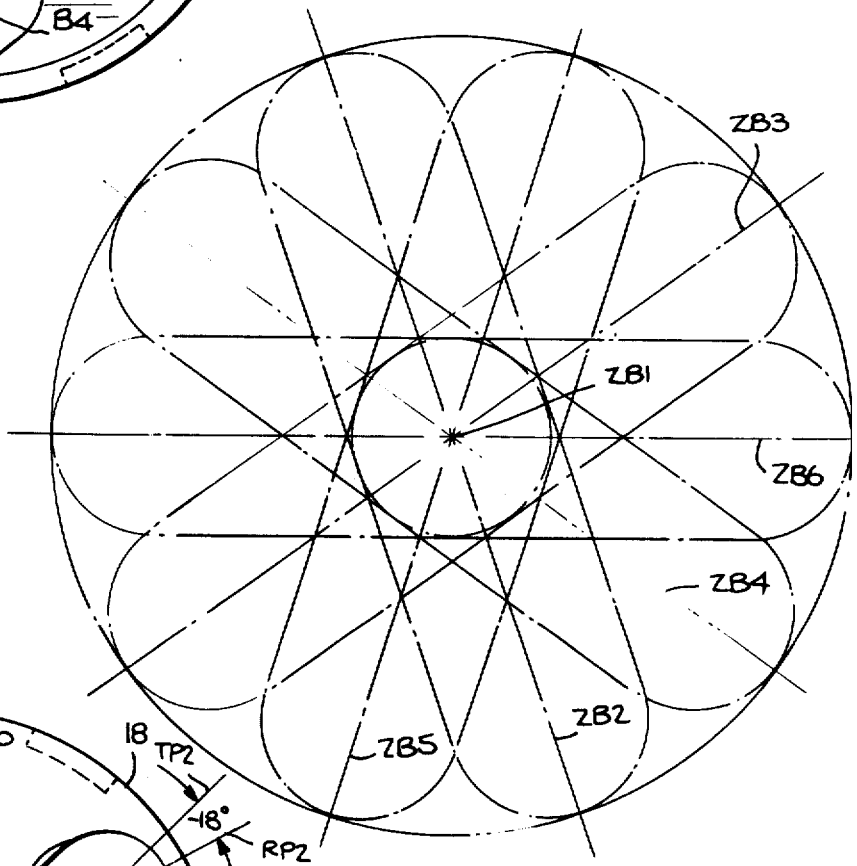
Fig. 6.
Fig. 4.
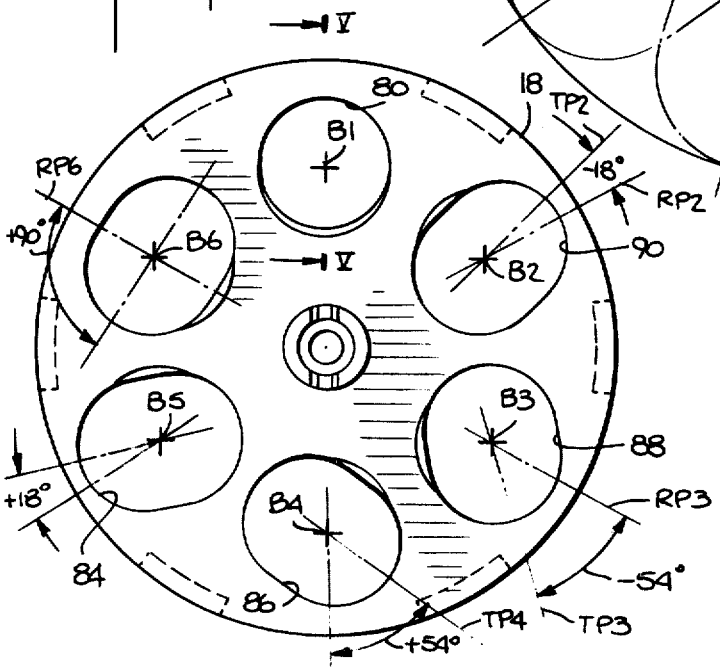

BURST DISPERSION CONTROL

BACKGROUND OF THE INVENTION

1. Field of the Invention

This invention relates to controlling the dispersion of rounds of ammunition fired by a Gatling-type gun.

2. Prior Art

In many situations, it is desirable that not all of the rounds of ammunition fired by a gun in a burst impact at the same target point. Due to the inherent inaccuracies of the sight, gun laying, and ballistics system, it is frequently desirable to provide a shot-gun or scatter-gun effect, as for example, when shooting at a rapidly moving single target or at a closely packed group of targets. In the Model 1874 Gatling, a cam track and a pin follower oscillator were provided which automatically transversed the entire gun on its mount. This provided a linear, horizontal dispersion of the burst. Arter, in U.S. Pat. No. 1,334,983, issued Mar. 30, 1920, shows a salvo firing gun having a plurality of gun barrels mounted in an annular row which does not rotate within a stationary housing. The longitudinal orientation of the gun barrels may be adjusted by a hand crank on a jack screw which operates a crank linkage. All of the gun barrels are charged concurrently and manually by a ring clip and are fired concurrently. Arntzen, in U.S. Pat. No. 1,448,587, issued Mar. 13, 1923, shows merely a plurality of gun barrels mounted in a stationary block. The barrels are arranged in two concentric, non-rotating rings of barrels about a single barrel. The longitudinal orientation of the outer barrels may be adjusted by a cam plate operating on a plurality of cam followers which are respectively fixed to the gun barrels. The cam plate is translated longitudinally by a plurality of jack screws. Dodge, in U.S. Pat. No. 1,551,809, issued Sept. 1, 1925, shows the use of a plurality of independent guns, each having its respective housing and a single gun barrel mounted to a common support member which is journaled for rotation about a longitudinal axis of rotation. The angle at which each gun is mounted to the common support member is adjustable by a bell crank. Perrin et al., in U.S. Pat. No. 3,897,714, issued Aug. 5, 1975, shows a conventional Gatling-type gun having a plurality of gun barrels whose distal ends are engaged by a cam plate. The deflection of the gun barrels may be positively adjusted by the cam plate, which plate may be translated longitudinally by a jack screw before or during firing.

SUMMARY OF THE INVENTION

It is an object of this invention to provide predetermined, large dispersion of burst fire of a Gatling-type gun. It is another object to provide such a dispersion which is uniform and circular.

A feature of this invention is the provision of a cam plate having a plurality of transversely elongated, gun-barrel receiving oversize openings, in one embodiment as cam slots, to guide the distal ends of respective certain gun barrels of a Gatling-type gun. Each distal end of the gun barrel is free within the length of its cam slot, but does remain in a neutral position in said slot when the gun is not firing. During firing, gun vibration, centrifugal force, and recoil motion combine to produce an apparently random cantilevered movement of the distal end of the gun barrel within the length of its slot and, thus, a random barrel dispersion.

BRIEF DESCRIPTION OF THE DRAWING

These and other objects, features, and advantages of the invention will become apparent from the following specification thereof, taken in conjunction with the accompanying drawing in which:

FIG. 3 is a front-end view, looking aft, of the clamp assembly of FIG. 2;

FIG. 4 is an aft-end view, looking forward, of the clamp assembly of FIG. 2;

FIG. 6 is a plan of the desired dispersion of the projectiles fired from the gun barrels.

DESCRIPTION OF THE EMBODIMENT

Figure 1:
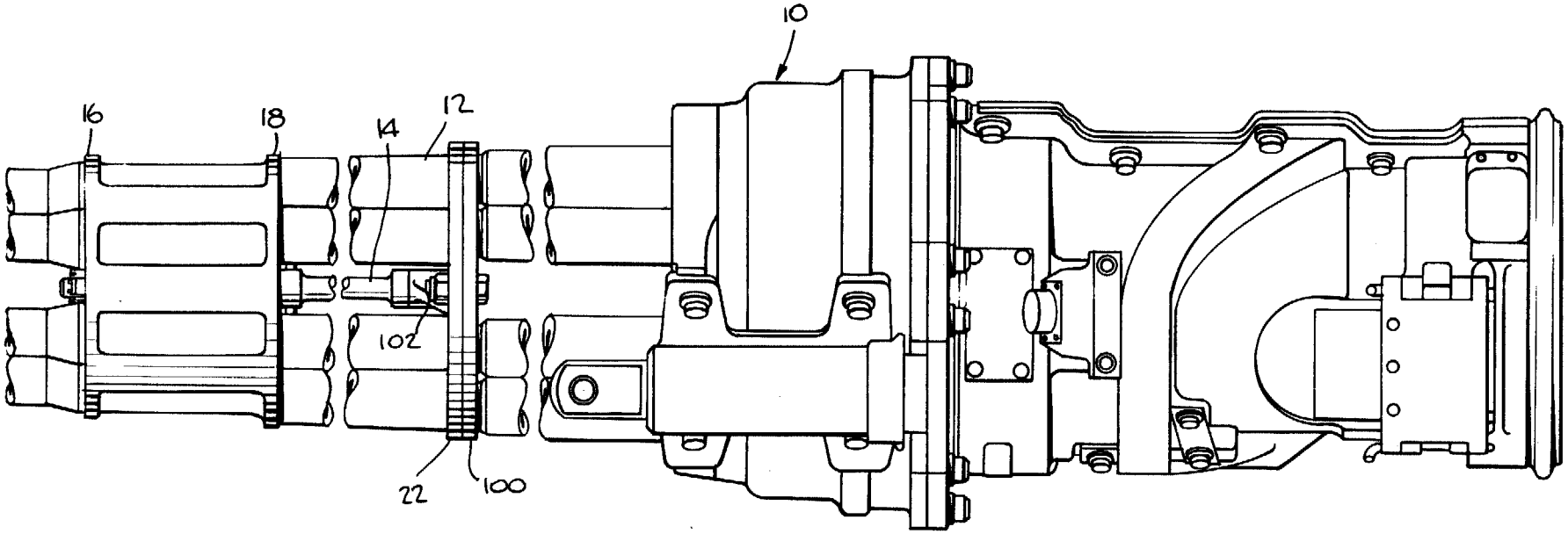
FIG. 1 is a side view in elevation of a Gatling-type gun embodying this invention.

A gun embodying this invention is shown in FIG. 1. The gun may be of the type shown by R. E. Chiabrandy in U.S. Pat. No. 3,380,343 issued on Apr. 30, 1968. The gun includes a housing 10 in which is journaled a roter to which are fixed, in an annular row or cluster, a plurality, here shown as six, longitudinally extending gun barrels 12. The cluster of barrels rotates about its longitudinal axis; and each barrel fires in sequence, conventionally at the 12 o'clock position.

A clamp assembly 14 is fixed to the cluster of barrels. The assembly 14 comprises a forward clamp or cage having a forward cam plate 16 and an aft cam plate 18 integrally connected by a plurality, here shown as six, longitudinally extending legs 20, a mid-barrel clamp 22, and a connecting rod 24. The cage has a longitudinal axial bore having an aft portion 26 of larger diameter, a forward portion 27 of smaller diameter, and a bore 28 with a diametric slot 30. The clamp has a longitudinal axial bore having a forward portion 32 of larger diameter, an aft portion 34 of smaller diameter, and a bore 36 with a diametric slot 38. The connecting rod has a main central portion of a diameter to fit the bores 26 and 32 and has end portions 40 and 42 of reduced diameter to fit the bores 28 and 34. The ends 40 and 42 are threaded to receive nuts 44 and 46 respectively, which are, in turn, pinned, and which longitudinally fix the cage and the clamp to the rod. The rod also carries two pins 48 and 50 which are respectively received by the slots 30 and 38 and which fix, against rotation, the cage and the clamp to the rod.

The forward cam plate 16 has a like plurality, here shown as six, longitudinally extending apertures therein. One aperture 60 is a cylindrical bore having a longitudinal axis parallel to the longitudinal axis of the assembly 14. The other apertures 62, 64, 66, 68 and 70 are transversely elongated bores having respective longitudinal axes parallel to the longitudinal axis of the assembly but with a transversely elongated cross-section developed by a cylindrical bore having a longitudinal axis which is translated, along a plane, to a position which is parallel to its initial position. A normal radius plane may be taken to pass through the longitudinal axis of the clamp assembly and the longitudinal axis of the respective bore.

As seen in FIG. 6, the desired plan of dispersion over the target circle requires no additional dispersion of one barrel and does require uniform additional dispersion of the five remaining barrels. To achieve this, the barrel B1 is constrained to the normal bores 60 and 80 to shoot the central circular zone ZB1. The barrel B2 is free to move in the bores 70 and 90, whose plane of translation TP2 is tilted −18° from the normal radius plane RP2, to shoot the elongated zone ZB2. The barrel B3 is free to move in the bores 68 and 88, whose plane of translation TB3 is tilted −54° from the normal radius plane RP3, to shoot the elongated zone ZB3. The barrel B4 is free to move in the bores 66 and 86, whose plane of translation TP4 is tilted +54° from the normal radius plane RP4, to shoot the elongated zone ZB4. The barrel B5 is free to move in the bores 64 and 84, whose plane of translation TP5 is tilted +18° from the normal radius plane RP5, to shoot the elongated zone ZB5. The barrel B6 is free to move in the bores 62 and 82, whose plane of translation TP6 is tilted +90° from the normal radius plane RP6, to shoot the elongated zone ZB6. The five planes of translation, taken as a group, divide the target circle into a like number of congruent sectors having equal radii and included angles.

The diameter of the bore 60 is made substantially equal to the diameter of the gun barrel received therein. The shorter diameter of the apertures 62, 64, 66, 68 and 70 is slightly larger to provide clearance for the movement of the respective gun barrel received therein. The longer diameter of these apertures is made significantly larger than the diameter of the gun barrel to provide clearance for oscillation of the distal portion of the respective gun barrel along the respective plane of translation.

The aft cam plate 18 has a similar, but not identical, set of six longitudinally extending apertures 80, 82, 84, 86, 88, and 90 therein. The dimensions of the apertures are made larger to accommodate the larger dimensions of that portion of the respective gun barrel received therein.

Figures 2, 5:
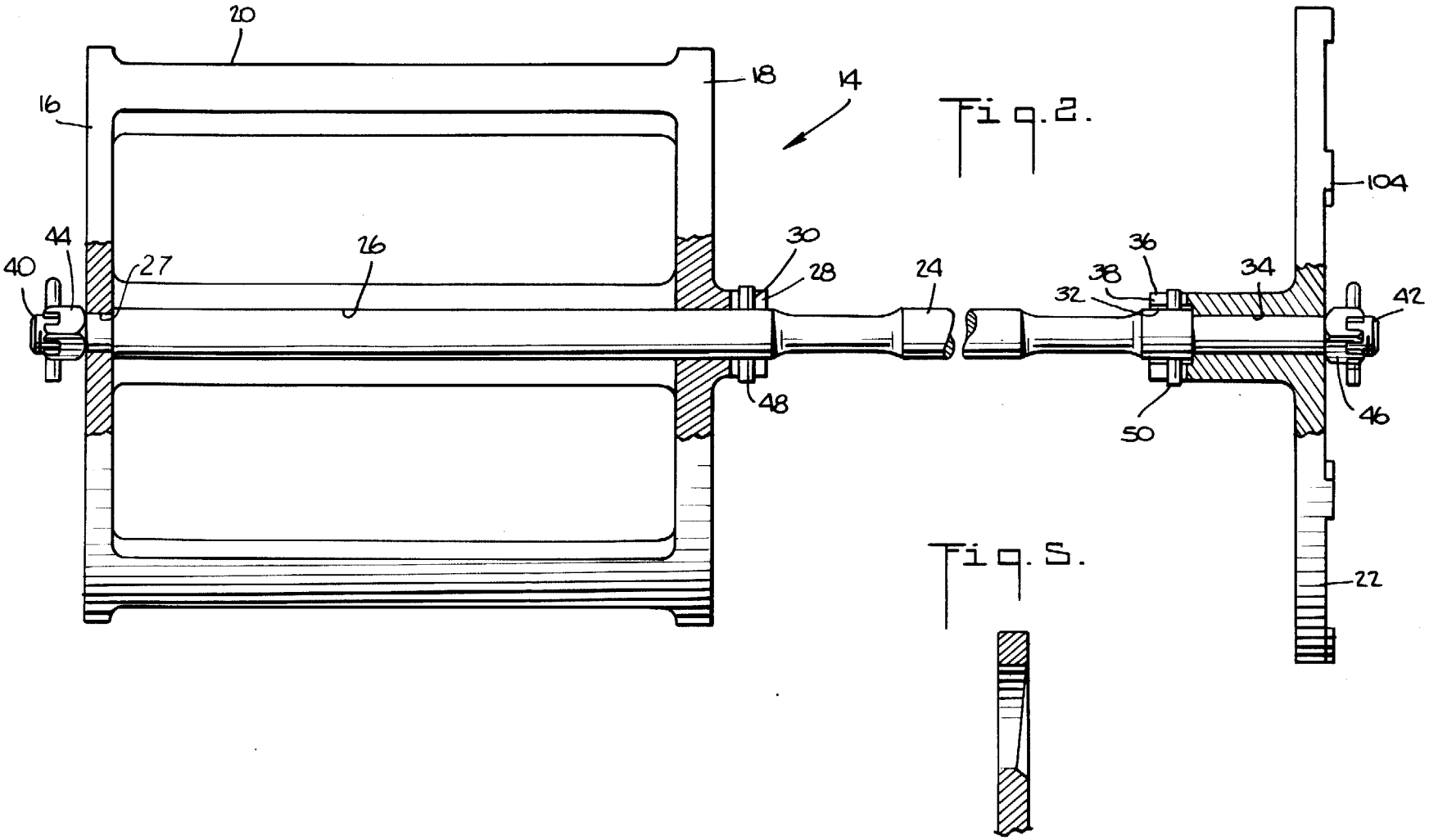
FIG. 2 is a side view in elevation of a clamp assembly for the gun barrels of the gun in FIG. 1.
FIG. 5 is a detail view, in cross-section, taken along the plane V—V of FIG. 4.

The counter-boring at a slant of the apertures in plate 18, as shown in FIGS. 4 and 5, is provided to permit easy assembly of the plate onto the gun barrels.

The aft cam plate 22 is fixed onto the cluster of gun barrels by means of a clamp ring 100, to which it is held by a plurality of bolts and nuts 102 and interlocking projections 104 and recesses.

When the gun is not firing, the barrels assume their inward-most, or neutral, positions in their respective slots. During firing, centrigfugal force urges the barrels outward. Variations in force, provided by startup, gun vibration, and recoil motion, cause the barrels to oscillate within their respective slots.

Dispersion patterns other than that shown in FIG. 6 may be readily obtained by plates embodying this invention. The length and orientation of the slots may be varied. More gun barrels may be fixed, e.g. three gun barrels may be fixed and three may be free. In this case, the clamp plate 22 may be omitted, and the plate 18 may be secured to the fixed three barrels. Oversize circular bores, rather than slots, may be provided. Circular bores are more readily machined than slots.

What is claimed is:

1. A gun comprising:

a stationary housing;

a rotor having a plurality of longitudinally extending gun barrels and journaled for rotation about a longitudinal axis within said housing; and control means operable while said rotor is operating for varying the longitudinal alignment of at least one of said gun barrels with respect to said longitudinal axis;

said control means including

[3]a muzzle constraint adjacent each of said barrels [4]at its respective distal end, said muzzle constraint having an oversize diameter bore receiving said one of said gun barrels and permitting free, cantilever,transverse vibrational movement of the distal end of said one of said gun barrels within said bore.

2. A gun according to claim 1 wherein:

said oversize diameter bore is a slot.

3. A gun according to claim 2 wherein:

said muzzle constraint has a respective elongated slot for each, less one, of said gun barrels, each of said slots permitting transverse movement of the distal end of said respective gun barrel.

4. A gun according to claim 2 wherein:

said muzzle constraint has a respective elongated slot for each, less one, of said gun barrels, each of said slots permitting transverse movement of the distal end of said gun barrel; and the remaining one gun barrel is constrained against such transverse movement.

5. A gun according to claim 2 wherein:

each of said gun barrels is adapted to fire in sequence when it passes through a common firing position in the rotation of said rotor, said firing position being determined by a stationary plane passing through the axis of rotation of said rotor and the axis of the gun barrel at said firing position;

each of said slots having a respective plane of translation;

each plane of translation defining a different angle with said stationary plane when the respective gun barrel is in said firing position.

6. A gun according to claim 5, for firing at a target circle, wherein:

said planes of translation, taken as a group, divide the target circle into a like number of congruent sectors having equal radii and included angles.

* * * * *

UNITED STATES PATENT OFFICE

CERTIFICATE OF CORRECTION

PATENT NO. : 4,015,508

DATED : April 5, 1977

INVENTOR(S) : Frederick M. Blodgett, Jr., Peter B. Schuyler

It is certified that error appears in the above-identified patent and that said Letters Patent are hereby corrected as shown below:

Claim 1, line 16, delete "3"; line 17, delete "4".

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*